US006742490B2

(12) United States Patent
Meisner

(10) Patent No.: US 6,742,490 B2
(45) Date of Patent: Jun. 1, 2004

(54) OIL PICKUP TUBE ASSEMBLY

(75) Inventor: David B. Meisner, Carol Stream, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/260,759

(22) Filed: Sep. 30, 2002

(65) Prior Publication Data

US 2004/0060533 A1 Apr. 1, 2004

(51) Int. Cl.[7] ..... F01M 1/00
(52) U.S. Cl. ..... 123/196 R; 184/12; 184/106
(58) Field of Search ..... 123/196 R, 195 C; 184/12, 106

(56) References Cited

U.S. PATENT DOCUMENTS 4,479,463 A 10/1984 Curley et al.
5,887,565 A * 3/1999 Ozeki et al. ..... 123/196 R
5,988,134 A 11/1999 Smietanski
6,142,257 A * 11/2000 Bruener et al. ..... 184/12

* cited by examiner

*Primary Examiner*—Tony M. Argenbright
*Assistant Examiner*—Katrina B. Harris
(74) *Attorney, Agent, or Firm*—Susan L. Lukasik; Dennis Kelly Sullivar; Jeffrey P. Calfa

(57) ABSTRACT

An apparatus for and method of mounting a flange to an oil pickup tube uses a bracketed flange mounting (201, 203, and 205). The bracketed flange mounting includes a flange (203) with a flange extension (205) in connection with a bracket (201) that is mounted to an oil pickup tube (101) between its two ends. The bracketed flange mounting (201, 203, and 205) may couple to an engine crank case or oil pump inlet in the same way as prior assemblies without a bracketed flange mounting, thus no retooling of any other part of the engine is required.

17 Claims, 5 Drawing Sheets

OIL PICKUP TUBE ASSEMBLY

FIELD OF THE INVENTION

This invention relates to an oil pickup tube assemblies for internal combustion engines, including but not limited to mounting of oil pickup tube assemblies within an oil pan of an internal combustion engines.

BACKGROUND OF THE INVENTION

Known engine oil pickup tubes, such as that shown in FIG. 1, include an assembly comprising a flange 103 brazed to one end of a tube 101 and a suction end 107 at the other end of the tube 101. The flange 103 has one or more holes 105 through which bolts attach to the oil pump inlet of the engine near the top of the oil pan. The tube curves downwardly such that the suction end is located near the bottom of the oil pan. The tube is thus suspended from the lower portion of the engine crank case or oil pump inlet.

Because of the nature of the design of such oil pickup tubes, engine vibration and other environmental conditions may cause the tube 101 to cantilever from its flange 103, causing cracks in the flange 103 and/or the brazed joint 109 and/or the tube 101 itself. These cracks result in leakage that reduces oil pressure. When oil pressure is reduced significantly, the engine may not operate or may suffer severe wear.

Accordingly, there is a need for a method of mounting an engine oil pickup tube that is not as susceptible to engine vibration or other environmental conditions.

SUMMARY OF THE INVENTION

An oil pickup tube assembly comprises an oil pickup tube having a first end and a second end. A bracketed flange mounting comprises a flange disposed near the first end of the oil pickup tube and having a flange extension and a bracket having a first end in connection with the flange extension and a second end mounted at an area of the oil pickup tube between the first end and the second end.

DESCRIPTION OF A PREFERRED EMBODIMENT

The following describes an apparatus for and method of mounting a flange to an oil pickup tube. A bracketed flange mounting includes a flange with a flange extension in connection with a bracket that is mounted to the oil pickup tube between its two ends. The bracketed flange mounting may couple to the engine in the same way as the prior assembly without a bracketed flange mounting, thus no retooling of any other part of the engine is required.

Figures 1, 2:
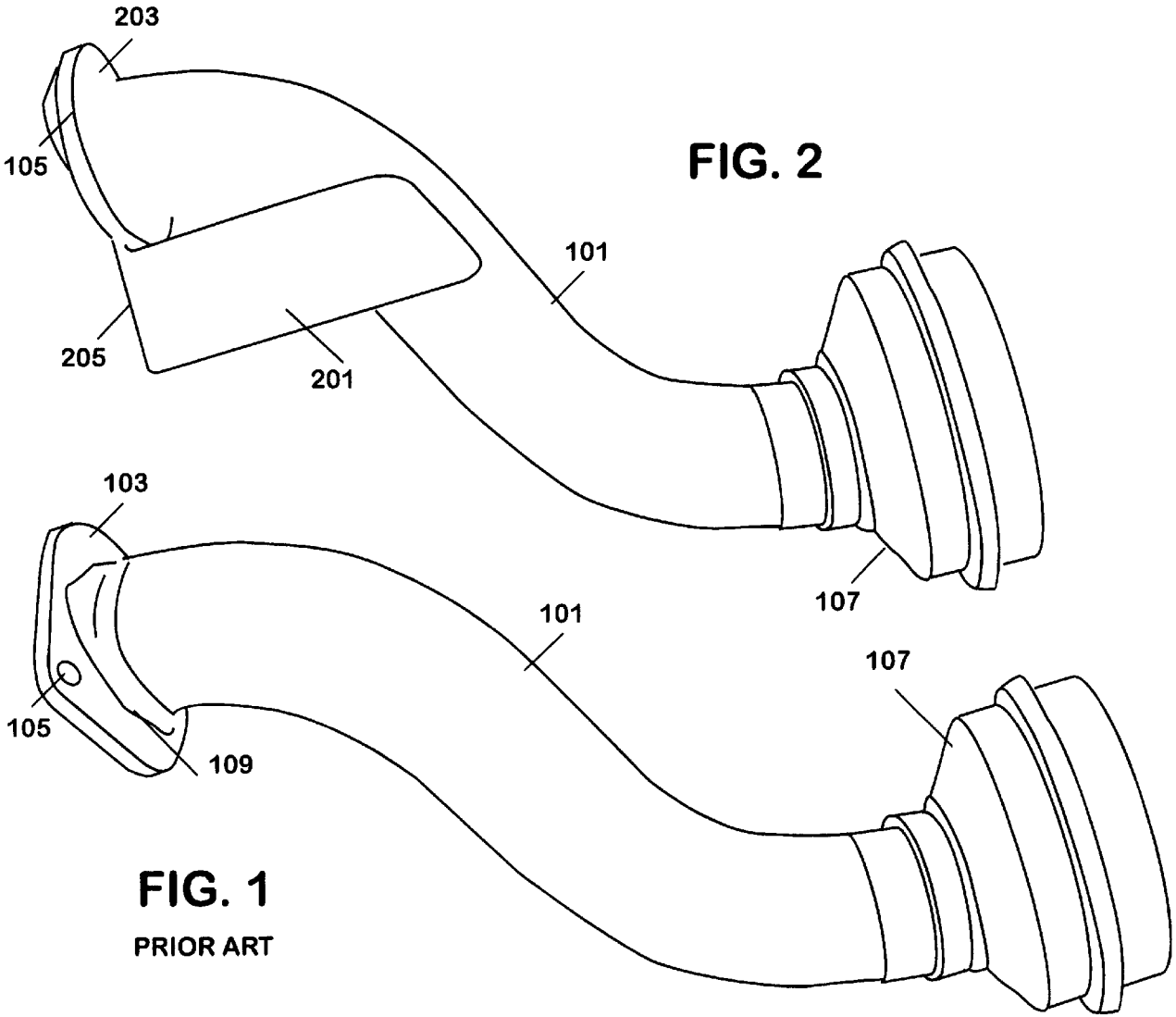
FIG. 1 PRIOR ART
FIG. 1 is a perspective view of an oil pickup tube.
FIG. 2 is a perspective view of an oil pickup tube with a bracketed flange mounting in accordance with the invention.

A perspective view of an oil pickup tube with a bracketed flange mounting is shown in FIG. 2. The bracketed flange mounting comprises a bracket 201 that mounts to the oil pickup tube and connects with a flange assembly. The flange assembly comprises a flange 203 with a flange extension 205 that are shown as coplanar in the drawings. The bracket 201 forms a substantially 90 degree angle with the flange extension 205.

Figure 3:
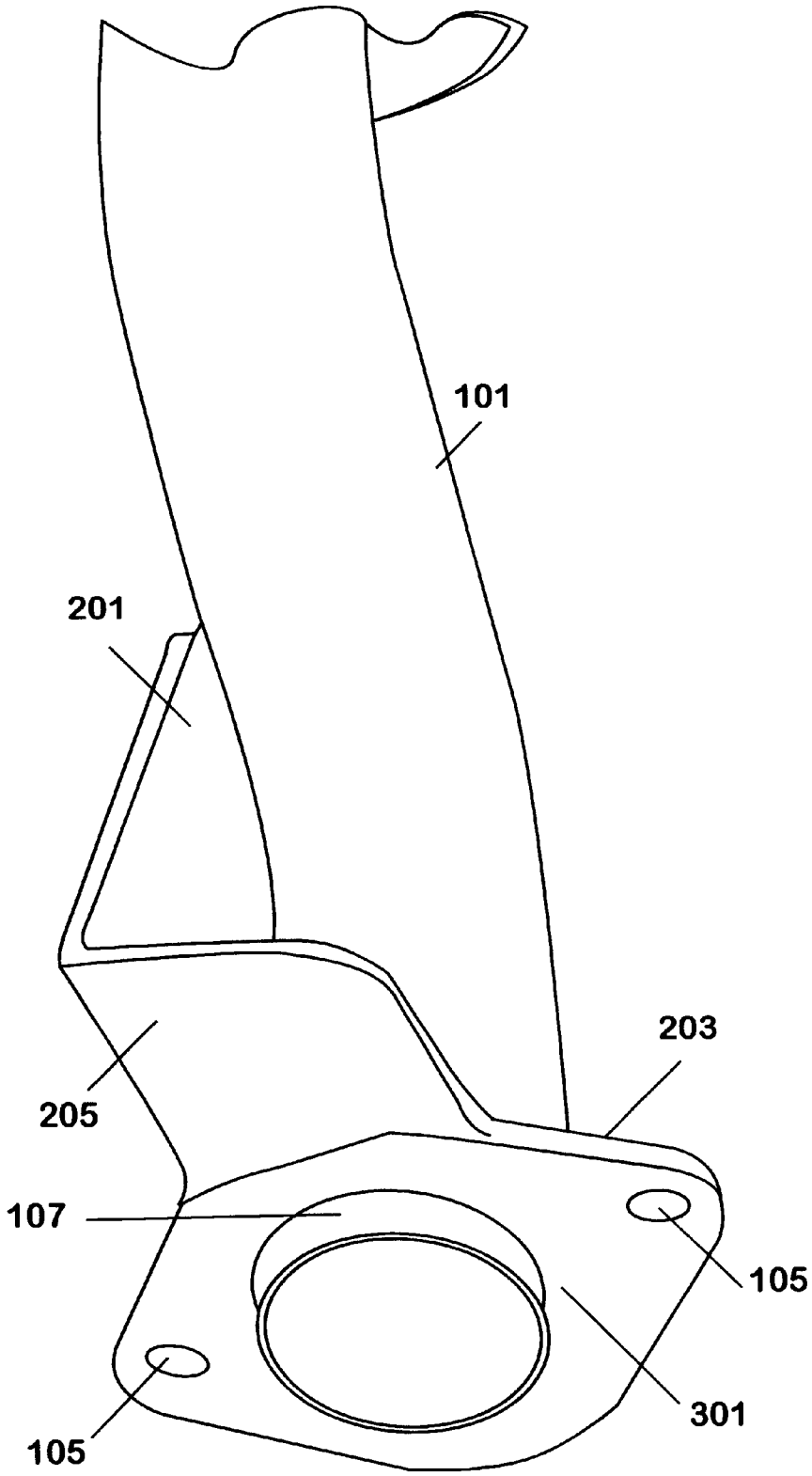
FIG. 3 is an end view of a bracketed flange mounting for an oil pickup tube in accordance with the invention.
Figure 4:
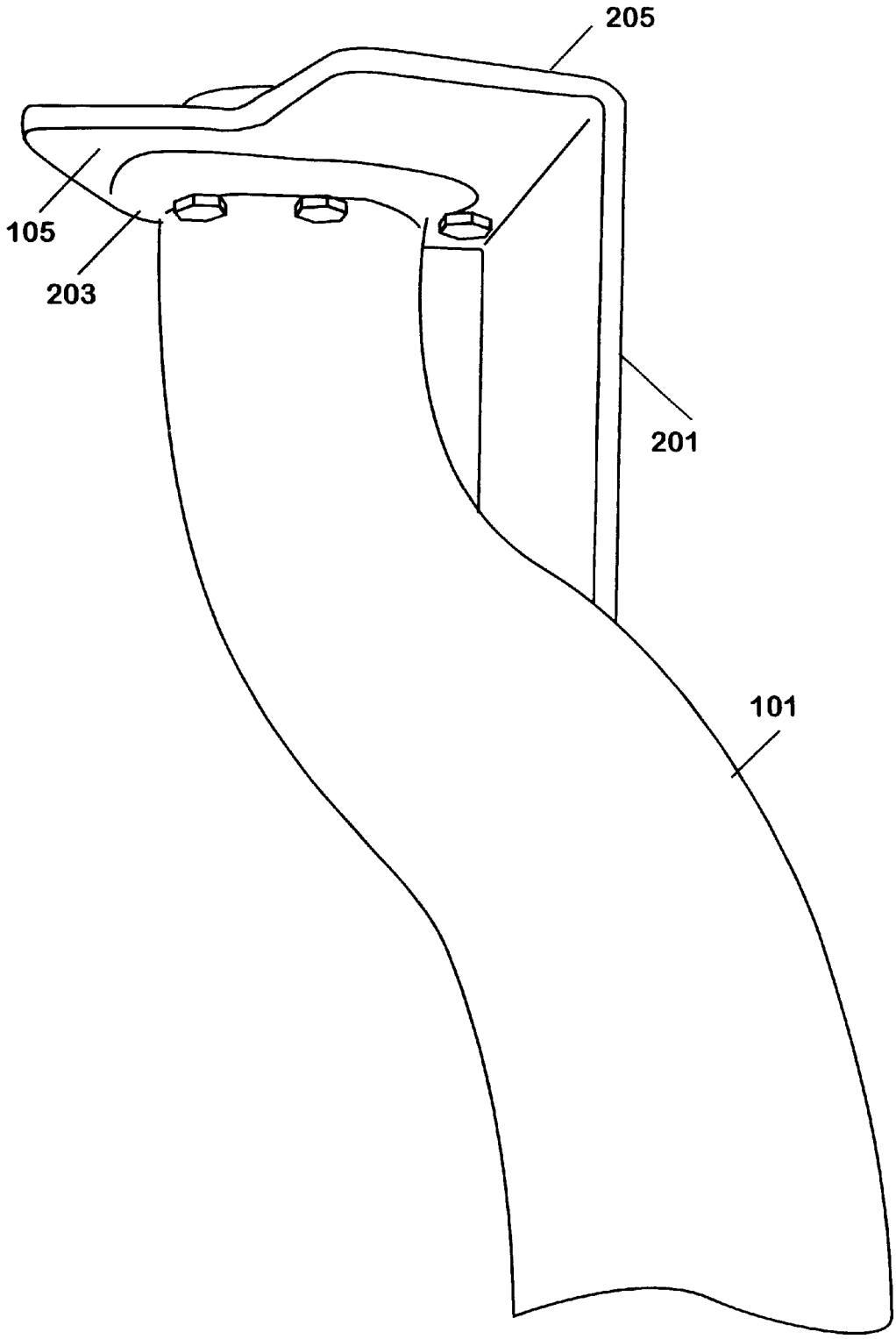
FIG. 4 is a view of the inside of a bracketed flange mounting for an oil pickup tube in accordance with the invention.
Figure 5:
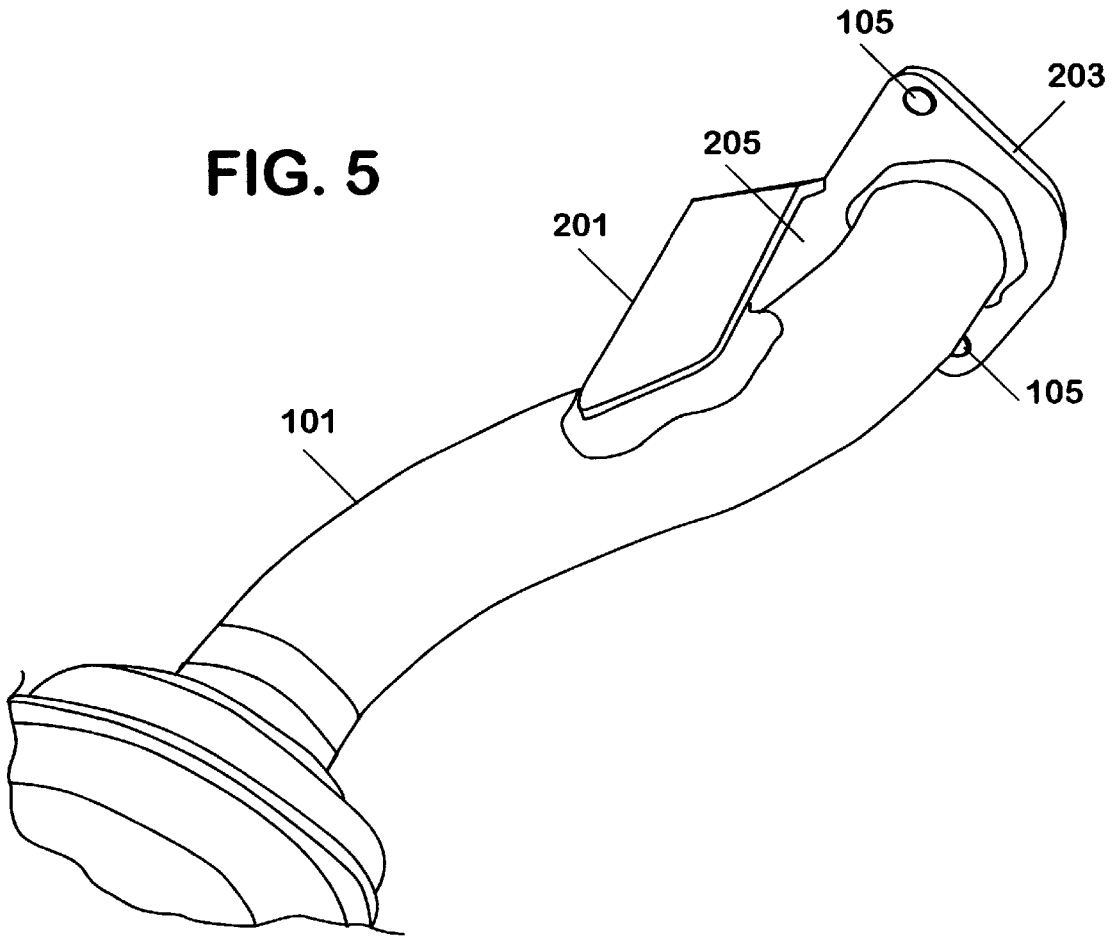
FIG. 5 is a side view of a bracketed flange mounting for an oil pickup tube in accordance with the invention.

An end view of a bracketed flange mounting for an oil pickup tube is shown in FIG. 3. The bracket 201 is shown connected to one side of the oil pickup tube 101. The bracket 201 is preferably welded to the oil pickup tube 101, although other methods of connection, such as brazing, may be employed. FIG. 4 and FIG. 5 show additional views of the bracketed flange mounting as it is mounted to the oil pickup tube.

The flange 203 is very similar to the old flange 103 in that it has the same insertion hole 301 in which the oil pickup tube is disposed prior to brazing. The flange 203 has the same size mounting holes 105 for inserting bolts to mount the oil pickup tube assembly to the engine crank case or oil pump inlet. The mounting holes 105 and the insertion hole 301 are in the same orientation and locations for both the old flange 203 and the new flange 203.

The flange extension 203 may be welded to the flange 203, in which case the old flange 103 may be utilized. The bracket 201 may be welded or otherwise connected to the flange extension 203. Advantageously, the flange 203 and flange extension 205 are constructed as a single unit from a single piece of metal, such as steel. Further advantage is obtained when the flange 203, flange extension 205, and bracket 201 are constructed as a single unit from a single piece of similar metal.

Figure 6:
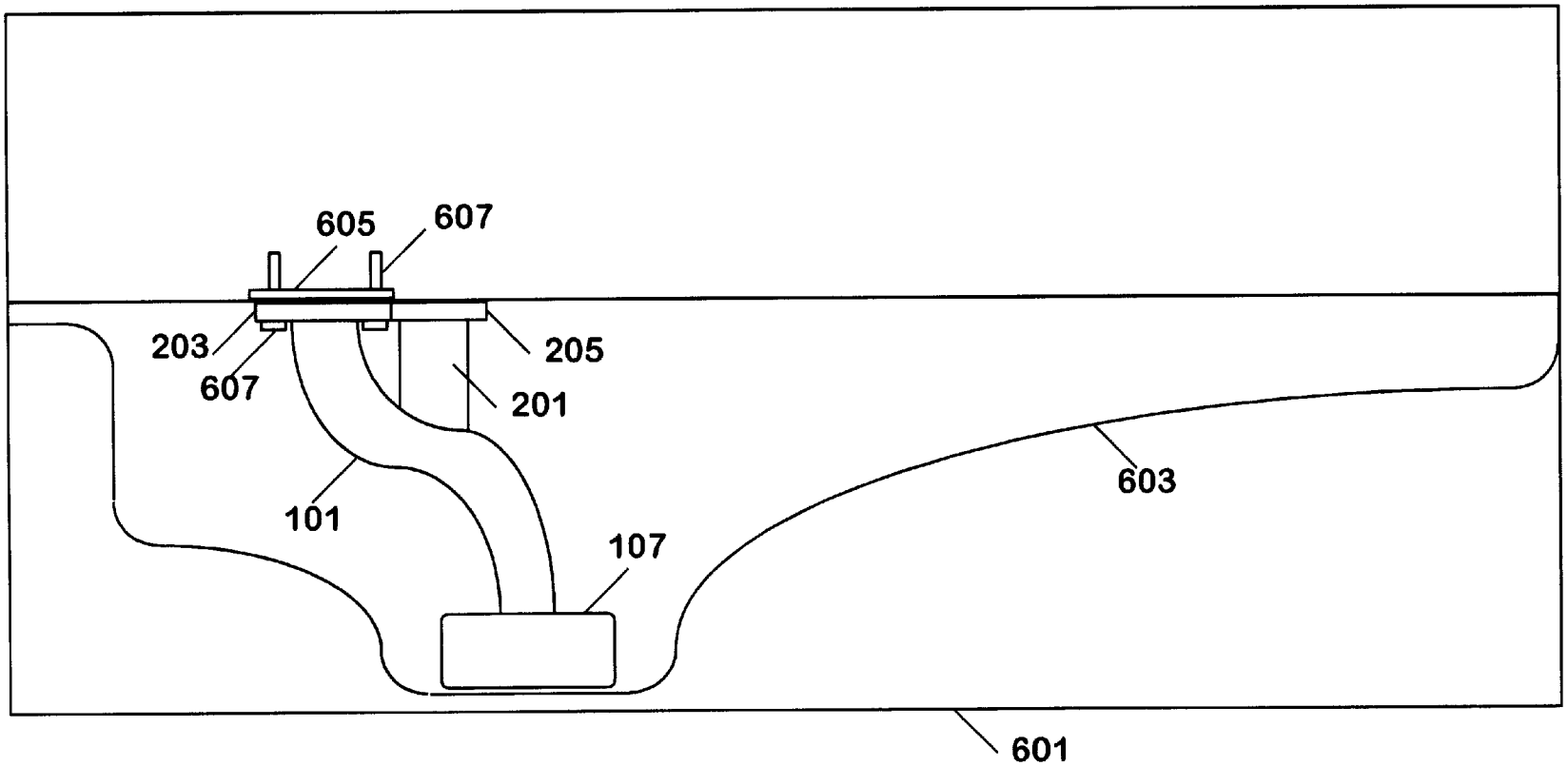
FIG. 6 is a diagram of an oil pickup tube with a bracketed flange mounting suspended within the oil pan of an engine in accordance with the invention.

A diagram of an oil pickup tube with a bracketed flange mounting suspended within the oil pan of an internal combustion engine 601 is shown in FIG. 6. The tube 101 is suspended from the lower portion of the engine crank case or oil pump inlet 605. Bolts 607 through the flange holes 105 hold the oil pickup tube assembly to the lower portion of the engine crank case or oil pump inlet 605.

Because the insertion hole of the flange is circular as is the outer diameter of the oil pickup tube, the flange and oil pickup tube may be oriented anywhere along the 360 degrees about which the two rotate with each other. It may be desirable to orient the oil pickup tube 101 in a certain way within the oil pan 603. In order to achieve the desired orientation, the flange must be oriented to the oil pickup tube in a particular way. In order to provide this orientation, previous methods utilize a fixture to align the tube 101 with the flange 103. When the flange 302 is disposed on the oil pickup tube 101 and the bracket 201 is mounted to the oil pickup tube 101 as shown in the drawings, the flange 203 is automatically placed in its desired position with respect to the oil pickup tube 101, thereby eliminating the need for a fixture to align the tube 101 and flange 203. The flange 203 is easily brazed to the oil pickup tube 101 in its desired orientation once the bracket 201 is mounted to the oil pickup tube. Thus, selection of the orientation of the members of the bracketed flange mounting serves to align the bracketed flange mounting with the oil pickup tube 201 as well as reduce vibration in the oil pickup tube assembly.

The same hole sizes and spacing are utilized for the present oil pickup tube assembly so that this assembly mounts in the same place and the same way as the prior assembly shown in FIG. 1, i.e., mounts to the same holes near the oil pump inlet of the engine near the top of the oil pan. Thus, there is no need to retool the holes near the oil pump inlet with the assembly of FIG. 2. Nevertheless, the mounting holes may be repositioned to further improve vibration resistance and take greater advantage of the added brace.

The present invention provides advantage to internal combustion engines that utilize oil pickup tubes. The bracketed flange mounting of the present invention does not require additional connections to the engine that may be complicated and add to manufacturing costs and/or time. Vibration reduction is provided with minimal additional cost and complexity. The need for alignment fixtures is eliminated.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An assembly comprising:

an oil pickup tube having a first end and a second end; and a bracketed flange mounting comprising:

a flange disposed near the first end of the oil pickup tube and having a flange extension; and a bracket having a first end in connection with the flange extension and a second end mounted at an area of the oil pickup tube between the first end and the second end.

2. The assembly of claim 1, wherein the flange further comprises a plurality of holes disposed therein.

3. The assembly of claim 1, wherein the bracket and the flange with the flange extension are oriented in only one orientation with respect to the oil pickup up tube when the flange is disposed on the oil pickup tube and the bracket is mounted to the oil pickup tube.

4. The assembly of claim 1, wherein the flange is brazed to the oil pickup tube.

5. The assembly of claim 1, wherein the bracket is welded to the oil pickup tube.

6. The assembly of claim 1, wherein the flange with the flange extension is constructed from a single piece of metal.

7. The assembly of claim 1, wherein the bracket and the flange with the flange extension are constructed from a single piece of metal.

8. The assembly of claim 1, wherein the flange and the flange extension are coplanar and wherein the bracket forms a substantially 90 degree angle with the flange extension.

9. The assembly of claim 1, wherein the flange is mountable to an oil pump inlet such that the oil pickup tube has a fixed orientation with respect to an oil pan.

10. An internal combustion engine comprising the assembly of claim 1.

11. An assembly comprising:

an oil pickup tube having a first end and a second end;

a bracketed flange mounting constructed from a single piece of metal and comprising a coplanar flange and flange extension and a bracket forming a substantially 90 degree angle with the flange extension;

wherein the flange is mounted near the first end of the oil pickup tube;

wherein the bracket is mounted to the oil pickup tube at an area between the first end and the second end.

12. The assembly of claim 11, wherein the flange further comprises a plurality of holes disposed therein.

13. The assembly of claim 11, wherein the bracket and the flange with the flange extension are oriented in only one orientation with respect to the oil pickup up tube when the flange is disposed on the oil pickup tube and the bracket is mounted to the oil pickup tube.

14. The assembly of claim 11, wherein the flange is brazed to the oil pickup tube.

15. The assembly of claim 11, wherein the bracket is welded to the oil pickup tube.

16. The assembly of claim 11, wherein the flange is mountable to an oil pump inlet such that the oil pickup tube has a fixed orientation with respect to an oil pan.

17. An internal combustion engine comprising the assembly of claim 11.

* * * * *